US006027047A

United States Patent [19]

Augustin

[11] Patent Number: 6,027,047

[45] Date of Patent: Feb. 22, 2000

[54] MAGNETIC VALVE-CONTROLLED INJECTOR FOR A STORAGE FUEL INJECTION SYSTEM OF A MULTI-CYLINDER INTERNAL COMBUSTION ENGINE

[75] Inventor: Ulrich Augustin, Kernen, Germany

[73] Assignee: Daimler Chrysler AG, Stuggart, Germany

[21] Appl. No.: 09/187,234

[22] Filed: Nov. 5, 1998

[30] Foreign Application Priority Data

Nov. 6, 1997 [DE] Germany ..... 197 48 999

[51] Int. Cl.[7] ..... F02M 51/06

[52] U.S. Cl. ..... 239/533.3; 239/585.1

[58] Field of Search ..... 239/88–92, 533.3, 239/533.8, 533.9, 585.1; 123/467

[56] References Cited

U.S. PATENT DOCUMENTS

| | | | |
|---|---|---|---|
| 4,603,671 | 8/1986 | Yoshinaga et al. | 123/467 |
| 5,671,715 | 9/1997 | Tsuzuki | 123/467 |
| 5,865,373 | 2/1999 | Buckley et al. | 239/88 X |

FOREIGN PATENT DOCUMENTS

| | | |
|---|---|---|
| 0 737 808 | 10/1996 | European Pat. Off. . |
| 25 14 457 | 1/1986 | Germany . |
| 196 12 738 | 10/1996 | Germany . |
| 195 16 565 | 11/1998 | Germany . |

*Primary Examiner*—Lesley D. Morris
*Attorney, Agent, or Firm*—Klaus J. Bach

[57] ABSTRACT

In a magnetic valve controlled fuel injector for a storage fuel injection system of a multi-cylinder internal combustion engine wherein the injector includes an upper housing part with a control piston, a lower housing part with a valve piston, a nozzle body with a spring loaded needle valve, and a fuel supply passage extending through the lower housing part to the valve piston and through the valve and control pistons to a control chamber from which fuel can be released under the control of a magnetic valve disposed on top of the upper housing part. The fuel supply passage further extends from the valve piston to a pressure chamber around the nozzle needle which when unseated by opening the magnetic control valve permits ejection of fuel from the pressure chamber. The valve and control piston which are disposed in the lower and respectively, upper housing parts are disposed in engagement with each other in the area of the jointure of the upper and the lower housing parts.

6 Claims, 1 Drawing Sheet

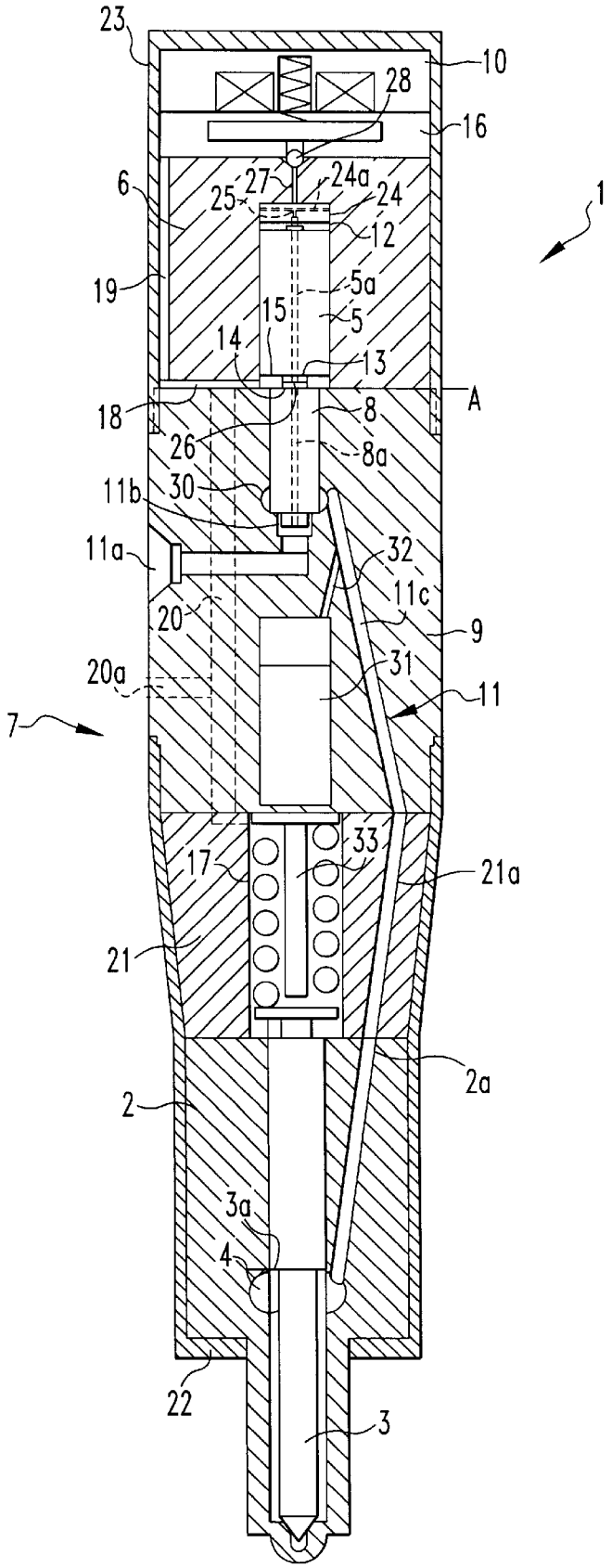
23
10
28
16
6
27
24a
25
24
1
12
19
5a
15
5
14
13
A
18
8
26
8a
11b
30
11a
32
11c
20
9
20a
31
11
7
33
17
21a
21
2a
2
3a
4
22
3

MAGNETIC VALVE-CONTROLLED INJECTOR FOR A STORAGE FUEL INJECTION SYSTEM OF A MULTI-CYLINDER INTERNAL COMBUSTION ENGINE

BACKGROUND OF THE INVENTION

The invention relates to a magnetic valve controlled injector for a storage (common rail) fuel injection system of a multi-cylinder internal combustion engine, comprising a multipart injector with an injector housing including a nozzle needle biased to a closed position by a spring disposed in a spring chamber behind the nozzle needle, a control piston disposed in a housing part and exposed to the fuel supply pressure and a valve element for controlling the fuel supply to the nozzle needle. The injector further includes at the side of the control piston remote from the nozzle needle a control chamber which is in communication with the pressurized fuel supply line by way of a passage extending through the control piston and including a valve element, and with a fuel drain line for releasing fuel by way of a magnetically controlled valve.

Such an injector is known for example from DE 196 12 738 A1. The injector disclosed therein includes a control piston with an integrated valve element. The control piston is guided in an upper and a lower housing part of the injector. The valve element is a cone-shaped rim extending around the control piston and forming a conical seating surface cooperating with a valve seat formed in the lower housing part. Because of the particular valve arrangement, the fuel supply line extends partially through the lower and partially through the upper housing part.

It is the object of the present invention to provide such an injector in which, with simple measures, internal sealing is improved while a slim injector design is maintained.

SUMMARY OF THE INVENTION

In a magnetic valve controlled fuel injector for a storage fuel injection system of a multi-cylinder internal combustion engine wherein the injector includes an upper housing part with a control piston, a lower housing part with a valve piston, a nozzle body with a spring loaded needle valve, and a fuel supply passage extending through the lower housing part to the valve piston and through the valve and control pistons to a control chamber from which fuel can be released under the control of a magnetic valve disposed on top of the upper housing part. The fuel supply passage further extends from the valve piston to a pressure chamber around the nozzle needle which when unseated by opening the magnetic control valve permits ejection of fuel from the pressure chamber. The valve and control piston which are disposed in the lower and respectively, upper housing parts are disposed in engagement with each other in the area of the jointure of the upper and the lower housing parts.

With the separation of the control piston and the valve element, manufacturing of the guide structure for the control piston is facilitated. Furthermore, there is no need for a high-pressure sealed separating surface area between the upper and the lower housing parts since the high pressure supply line extends only through the lower housing part. The upper part with the control piston includes no fuel supply passages. There is no need for precision machining. Only the separating surfaces must be high-pressure tight like in the conventional injectors.

The invention as shown in the drawings is described in greater detail below on the basis of an embodiment.

BRIEF DESCRIPTION OF THE DRAWINGS

The sole FIGURE is a cross-sectional view of the injector according to the invention.

DESCRIPTION OF A PREFERRED EMBODIMENT

A magnetic valve controlled injector 1 for a storage fuel injection system (common rail system) which is not shown of a multi-cylinder internal combustion engine comprises an injector housing 7 consisting essentially of an upper housing part 6 with an electromagnetic valve 10, a lower housing part 9, a nozzle body 2 and a pressure plate 21 disposed between the nozzle body 2 and the lower housing part 9. The nozzle body 2 slideably supports a spring loaded nozzle needle 3 with a pressure shoulder 3*a*. Adjacent the pressure shoulder 3*a*, the nozzle needle 3 is surrounded by a pressure chamber 4 to which fuel under pressure is supplied by way of a fuel supply passage 2*a*. The upper housing part 6 includes a control piston 5 and a valve element 8 which is disposed in the lower housing part 9 and which cooperates with the control piston 5. The magnetic valve 10 is disposed at the top end of the injector.

The valve element 8 comprises a servo valve piston which controls a fuel supply passage 11 (11*a*, 11*b*, 11*c*), which is connected to the pressurized fuel supply system and leads to the pressure space 4 around the nozzle needle 3. The fuel supply passage 11 includes a radial section 11*a* extending from the outer circumference of the lower housing part 9, a central passage section 11*b* leading from the radial section 11*a* to an annular chamber 30 surrounding the servo valve element 8 and a passage section 11*c* extending from the annular chamber 30 down-wardly through the lower housing part 9 and, by way of the passage section 21*a* extending through the pressure plate 21 and the passage section 2*a* extending through the nozzle body 2 to the pressure space 4 around the nozzle needle 3.

The piston of the servo valve element 8 is smaller in diameter than the control piston 5. The pistons include central through bores 8*a*, 5*a* which are disposed in axial alignment so as to form a communication passage from the radial fuel supply passage section 11*a* to a control space 12 delimited by the control piston 5, which communication passage is always open independently of the position of the control piston.

The adjacent contact or rather seal surfaces of the control piston 5 and the servo valve piston 8 are formed by small neck portions 13, 14 on the end faces of the two pistons. The engagement surfaces of the neck portions 13, 14 are disposed at the level of the separating plane A of the upper housing part 6 and the lower housing part 9. The diameter of the neck portions 13, 14 is smaller than the diameter of the servo valve piston 8. The two neck portions 13, 14 and the upper housing part 6 delimit an annular space 15, which is in communication with the magnetic valve chamber 16 by passages 18 and 19 and also with the nozzle spring chamber 17 by a passage 20. The passage 18 is a radial groove formed into the lower surface of the upper housing part 6, the passage 19 is an axial groove or a flat formed into the outer surface of the upper housing part 6, and the passage 20 is an axial bore extending through the lower housing part 9 parallel to the servo valve piston 8. In this way, a fuel drain connection is provided from the annular space 15 through the groove 18 to the bore 20, from the magnetic valve chamber 16 through the page 19, and the groove 18 and from the nozzle spring chamber 17 to the passage 20. The passage 20 may be connected to a fuel return line by way of a drain passage 20*a*.

The nozzle spring chamber 17 is disposed in the pressure plate 21 arranged between the nozzle body 2 and the lower housing part 9. The nozzle body 2 and the pressure plate 21 are held in firm engagement with the lower housing part 9 by a clamping sleeve 22. The magnetic valve 10 and the upper housing part are held in firm engagement with the lower housing part 9 by another clamping sleeve 23.

The control space 12 includes an axially movable platelet 24 which has a transverse groove 24*a* formed in its side adjacent the magnetic valve and which has a centrally arranged throttling bore 25. The throttling bore 25 has a small cross-section when compared with that of a fuel admission throttle 26 in the through bore 5*a* of the control piston 5 and a discharge throttle passage 27 extending between the control chamber 12 and the valve ball 28 of the magnetic valve 10. The platelet 24 with its well defined small throttling opening 25 minimized the leakage flow volume.

The lower housing part 9 includes a nozzle valve closing piston which is designated by the reference numeral 31 and which is in communication with the pressurized fuel supply passage 11 by way of a throttle passage 32. In case of a functional defect of the injector 1, the closing piston 31 moves the nozzle needle to a closing position by means of an operating rod 33 which is disposed in the needle nozzle spring chamber 17.

What is claimed is:

1. A magnetic valve controlled injector for a storage fuel injection system of a multi-cylinder internal combustion engine, said injector including a top housing part mounted on top of a bottom housing part, a magnetic valve disposed on top of the top housing part and a nozzle body including a spring-loaded nozzle needle disposed in a nozzle body arranged below the bottom housing part, said top housing part having a central bore forming a control cylinder with a control piston movably disposed therein, and said lower housing part having a central bore with a valve piston element movably disposed therein in engagement with said control piston and forming a piston controlled valve, a fuel supply passage extending through said lower housing and, by way of said piston-controlled valve, to a fuel pressure chamber formed around said nozzle needle for the ejection of high pressure fuel from said injector when said nozzle needle is lifted by the fuel pressure in said fuel pressure chamber, said control piston defining at its side remote from said nozzle needle a control chamber which is in communication with said fuel supply passage by way of a fuel passage extending through said control piston and said valve piston and with a fuel drain passage under the control of said magnetic valve, said valve piston having a smaller diameter than said control piston and engaging said control piston in the area of jointure of said housing top and said housing bottom parts.

2. An injector according to claim 1, wherein said control piston and said valve piston are provided with annular necks which project from the adjacent end faces of said control and valve pistons and by which they are in engagement with each other, and said fuel passages in said piston extend centrally through said annular necks for supplying fuel to said control chamber.

3. An injector according to claim 2, wherein, around said necks, an annular space is formed which is in communication with a spring chamber above said nozzle needle in which a spring is disposed providing a spring force for loading said valve needle and also with a space above said upper housing part in which said magnetic valve is disposed.

4. An injector according to claim 3, wherein the communication path between said annular space around said necks is formed by a radial groove in the upper housing part and an axial flattened area at the circumference of the upper housing part and the communication path to said spring chamber is formed also by said radial groove in the upper housing part and a communication passage branching off said radial groove and extending through said lower housing part.

5. An injector according to claim 1, wherein said nozzle body and a pressure plate disposed between said nozzle body are firmly connected to said lower housing part by a first clamping sleeve and said magnetic valve and said upper housing part are firmly connected to said lower housing part by a second clamping sleeve.

6. An injector according to claim 1, wherein a platelet is disposed in said control chamber above said control piston, said platelet having a central throttling bore which limits fuel release from said control chamber when said magnetic valve is opened for fuel ejection from said injector.

* * * * *